US009801413B2

(12) United States Patent
Zhu

(10) Patent No.: US 9,801,413 B2
(45) Date of Patent: Oct. 31, 2017

(54) ELECTRONIC CIGARETTE

(75) Inventor: Xiaochun Zhu, Shenzhen (CN)

(73) Assignee: Shenzhen Kontle Electronics CO., Ltd, Guangdong (CN)

( * ) Notice: Subject to any disclaimer, the term of this patent is extended or adjusted under 35 U.S.C. 154(b) by 1045 days.

(21) Appl. No.: 13/993,962

(22) PCT Filed: Mar. 30, 2011

(86) PCT No.: PCT/CN2011/072291
§ 371 (c)(1),
(2), (4) Date: Jun. 13, 2013

(87) PCT Pub. No.: WO2012/129787
PCT Pub. Date: Oct. 4, 2012

(65) Prior Publication Data

US 2013/0263869 A1 Oct. 10, 2013

(30) Foreign Application Priority Data

Mar. 28, 2011 (CN) ..... 2011 1 0075226

(51) Int. Cl.
*A24F 47/00* (2006.01)

(52) U.S. Cl.
CPC ..... *A24F 47/002* (2013.01); *A24F 47/008* (2013.01)

(58) Field of Classification Search
CPC .... A24F 47/002; A24F 47/004; A24F 47/008; A61M 15/06
USPC ..... 131/329
See application file for complete search history.

(56) References Cited

U.S. PATENT DOCUMENTS

| | | | | |
|---|---|---|---|---|
| 3,721,240 | A | 3/1973 | Tamburri | |
| 2005/0016550 | A1* | 1/2005 | Katase | A24F 47/002 131/194 |
| 2009/0165808 | A1 | 7/2009 | Melahropoulos | |
| 2011/0303231 | A1* | 12/2011 | Li | A24F 47/008 131/329 |
| 2012/0111347 | A1* | 5/2012 | Hon | A24F 47/008 131/329 |
| 2012/0279512 | A1* | 11/2012 | Hon | A24F 47/008 131/329 |

FOREIGN PATENT DOCUMENTS

| | | | |
|---|---|---|---|
| CN | 101606758 | A | 12/2009 |
| CN | 201379072 | Y | 1/2010 |

(Continued)

*Primary Examiner* — Joseph S Del Sole
*Assistant Examiner* — Mohamed K Ahmed Ali
(74) *Attorney, Agent, or Firm* — Sughrue Mion, PLLC

(57) ABSTRACT

An electronic cigarette is provided, which comprises a hollow atomizing stem (10), a first conductive ring (20) sleeved at the bottom of the atomizing stem (10) and airproof with the atomizing stem (10), a second conductive ring (30) arranged in the first conductive ring (20) and insulated from it, a conduit (40) held in the atomizing stem (10), with base contacting the first conductive ring (20) tightly, a liquid blocker (70) arranged on the top of the atomizing stem (10), and a cigarette holder (80) arranged on the top of the atomizing stem (10) simultaneously and holding the liquid blocker (70) The inner wall of said atomizing stem (10), the outer wall of said conduit (40), the top of said first conductive ring (20), and the bottom of said liquid blocker (70) together confine a liquid storage chamber (12) for storing tobacco juice.

13 Claims, 7 Drawing Sheets

(56) References Cited

FOREIGN PATENT DOCUMENTS

| | | | | | | |
|---|---|---|---|---|---|---|
| CN | 201379073 | Y | | 1/2010 | | |
| CN | WO 2010091593 | A1 | * | 8/2010 | ..... | A24F 47/008 |
| CN | 201602132 | U | | 10/2010 | | |
| JP | 3164992 | U | * | 12/2010 | ..... | A24F 47/008 |

* cited by examiner

ELECTRONIC CIGARETTE

SUMMARY OF THE INVENTION

The present invention relates to an electronic cigarette, and in particular, to an electronic cigarette which has no cigarette cotton in its structure.

BACKGROUND ART

An existing electronic cigarette structure is normally provided with a tobacco juice storage unit connected to a heating unit. Normally cigarette cotton is used as a guiding material for tobacco juice between the heating unit and the storage unit in the industry. The cigarette cotton used in the existing electronic cigarette increases the cost, and is neither environmental-friendly nor hygienic, which is likely to cause secondary pollution. In addition, the existing electronic cigarette structure has a poor sealing effect, which is prone to a tobacco juice leakage and may result in a poor atomizing effect of the electronic cigarette and a small amount of smoke, thereby affecting effect of use for a user to a certain extent. In addition, because the existing electronic cigarette requires its components to be welded, soldering tin and soldering flux need to be used during welding, which directly result in soldering tin pollution and soldering flux pollution.

Therefore, it is necessary to provide an improved electronic cigarette which overcomes the defects of the prior art.

CONTENT OF THE INVENTION

An object of the present invention is to provide an environmental-friendly and highly efficient electronic cigarette that has a scientific structure, a low cost, and a good atomizing effect.

To achieve the object, the present invention uses the following technical solution.

An electronic cigarette includes a hollow atomizing stem, a first conductive ring sleeved at the bottom of the atomizing stem and airproof with the atomizing stem, a second conductive ring arranged in the first conductive ring and insulated from it, a conduit held in the atomizing stem, with base contacting the first conductive ring tightly, a liquid blocker arranged on the top of the atomizing stem, and a cigarette holder arranged on the top of the atomizing stem simultaneously and holding the liquid blocker therein. The inner wall of said atomizing stem, the outer wall of said conduit, the top of said first conductive ring, and the bottom of said liquid blocker together confine a liquid storage chamber for storing tobacco juice.

Compared with the prior art, the present invention has the following advantages:

an integral design is realized for a heating unit and a tobacco juice storage unit of an electronic cigarette according to the present invention, a dedicated storage space is formed, the overall structure uses a vacuum-simulation design, and no cigarette cotton is required for guiding a flow between the tobacco juice storage unit and the heating unit, and the atomizing effect is obviously improved, so that a generated air flow may better meet requirements of an electronic cigarette, the taste is more close to a true cigarette, and at the same time tobacco juice is sealed for storage, and the validity duration of the tobacco juice is greatly increased; in addition, the overall structure of the electronic cigarette is simplified, manufacturing cost is reduced, and production efficiency is improved.

The components of the electronic cigarette according to the present invention are not connected by welding, which effectively avoids pollution of soldering tin and soldering flux, thereby making it more environmental-friendly and hygienic.

The liquid blocker, the cigarette holder, and the body of the electronic cigarette according to the present invention are detachably connected, and after the tobacco juice is depleted, refilling can be performed, thereby prolonging the service life of the electronic cigarette.

SPECIFIC EMBODIMENT

The present invention is further described below with reference to accompanying drawings and an embodiment.

Figure 1:
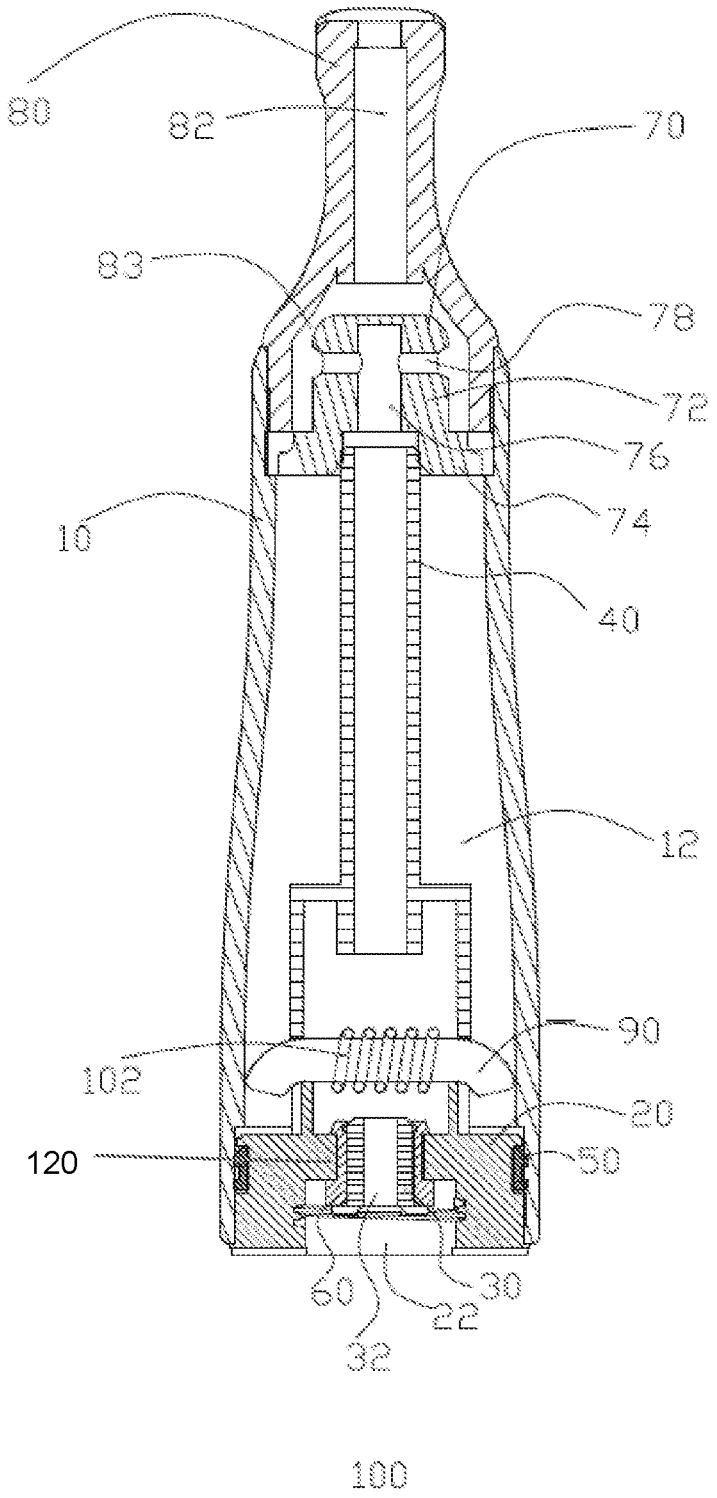
FIG. 1 is a sectional structural view of an electronic cigarette according to the present invention.
Figure 2:
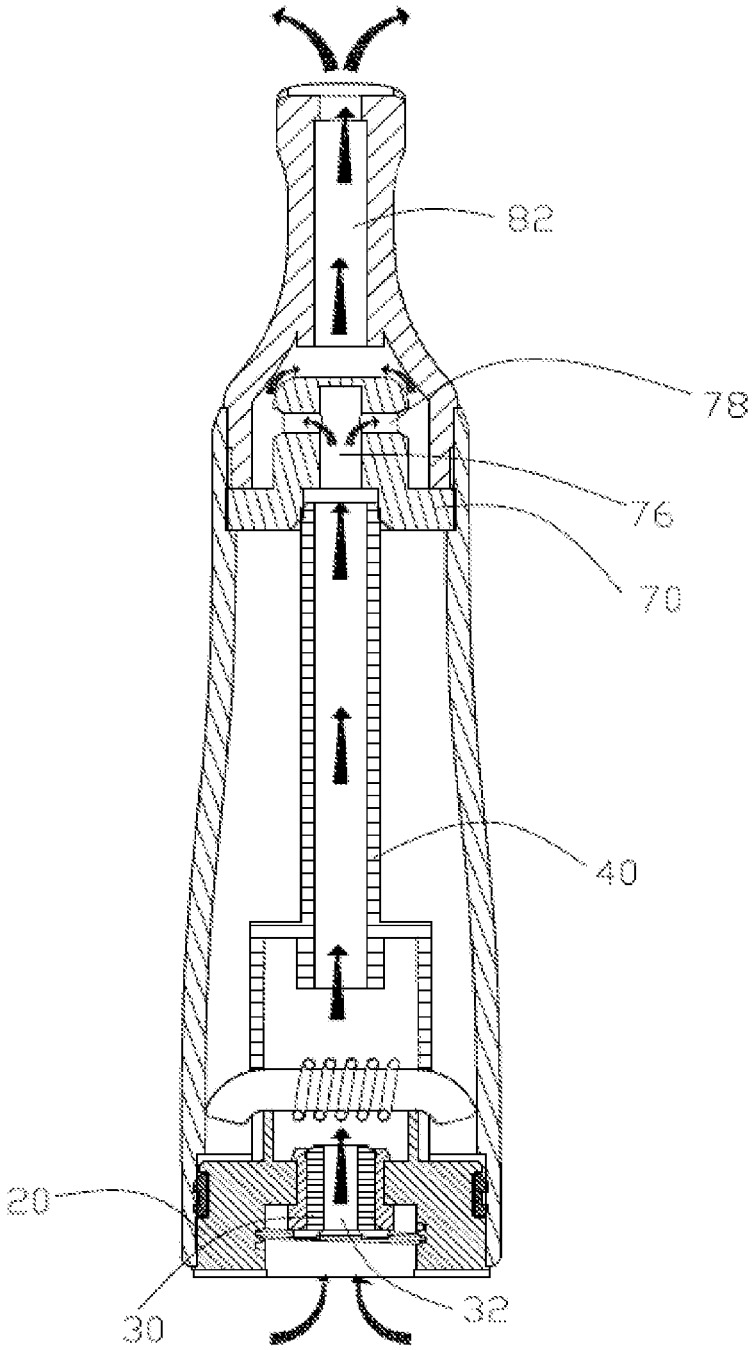
FIG. 2 illustrates a path though which an air flow of the electronic cigarette shown in FIG. 1 flows.
Figure 3:
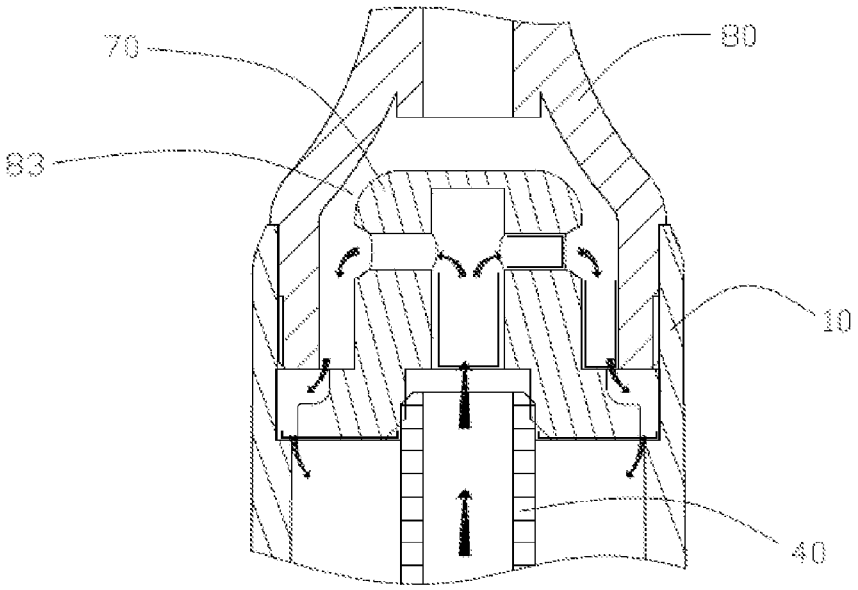
FIG. 3 illustrates in detail a flow path of the air flow path shown in FIG. 2 at the top of the electronic cigarette.
Figure 4:
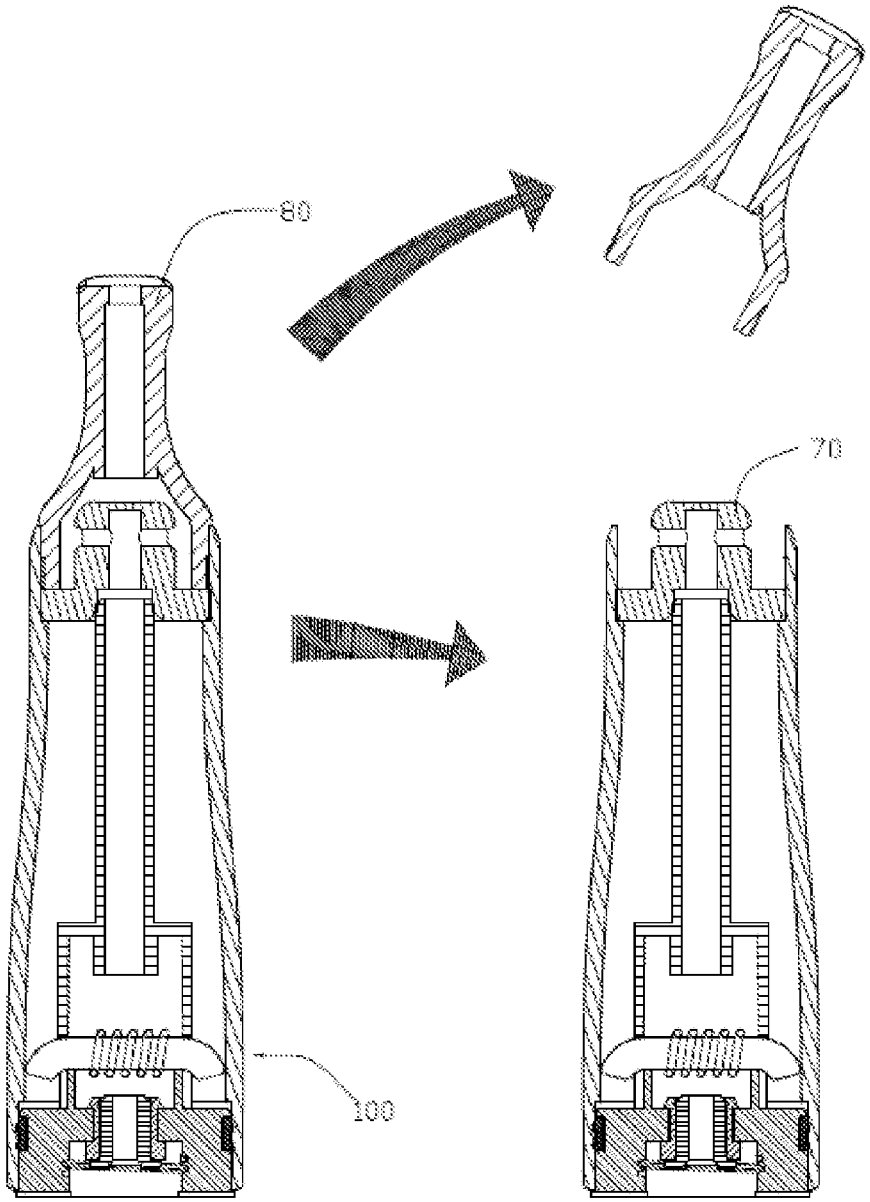
FIG. 4 illustrates one of steps of filling tobacco juice into the electronic cigarette according to the present invention.
Figure 5:
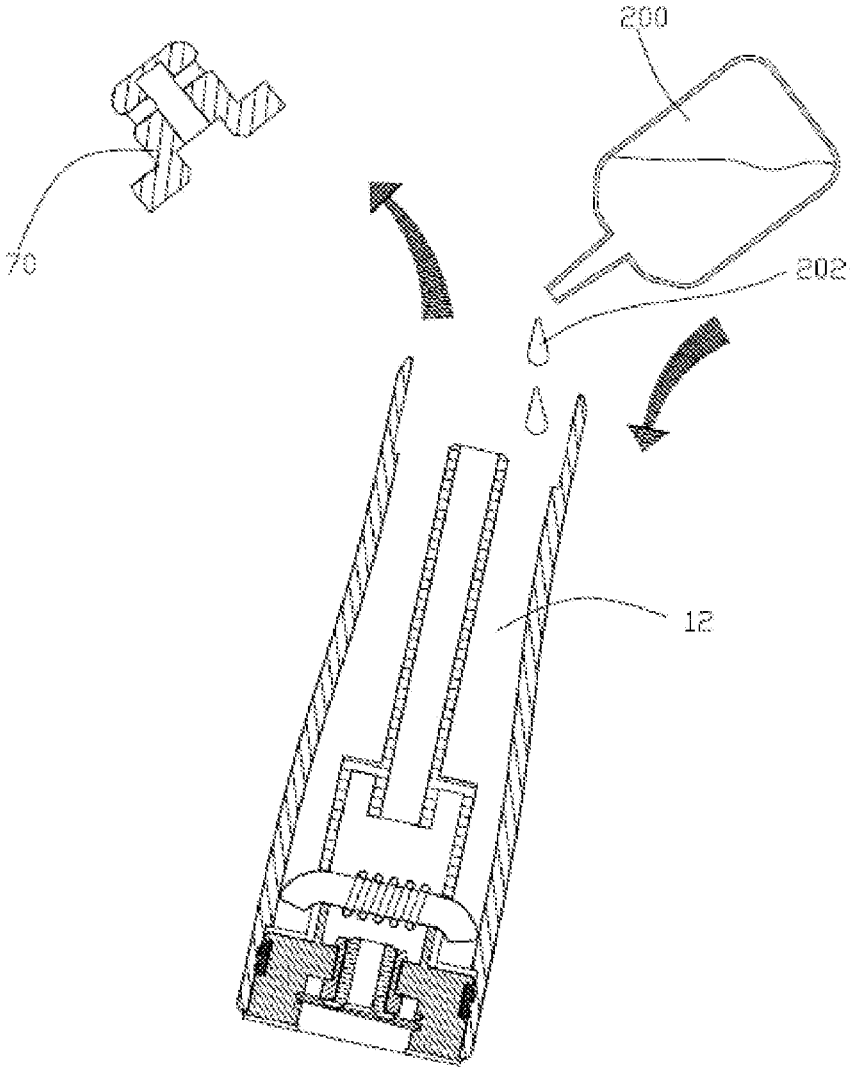
FIG. 5 illustrates one of steps of filling tobacco juice into the electronic cigarette according to the present invention.
Figure 6:
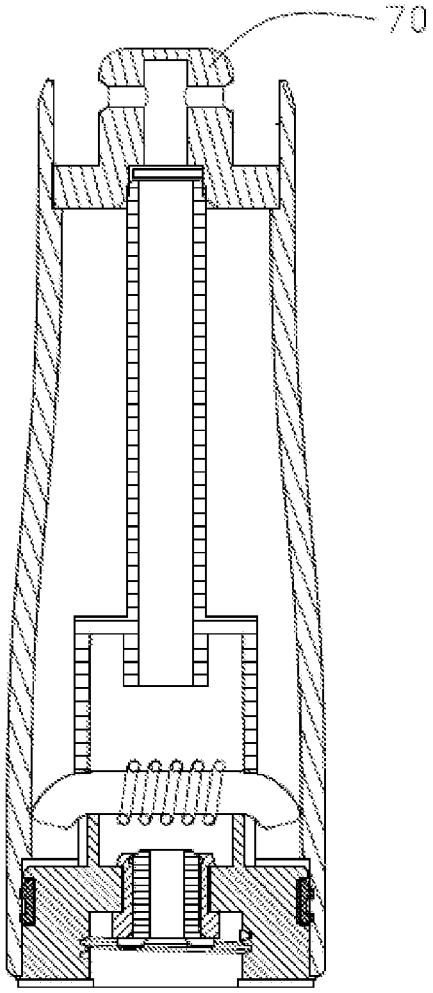
FIG. 6 illustrates one of steps of filling tobacco juice into the electronic cigarette according to the present invention.
Figure 7:
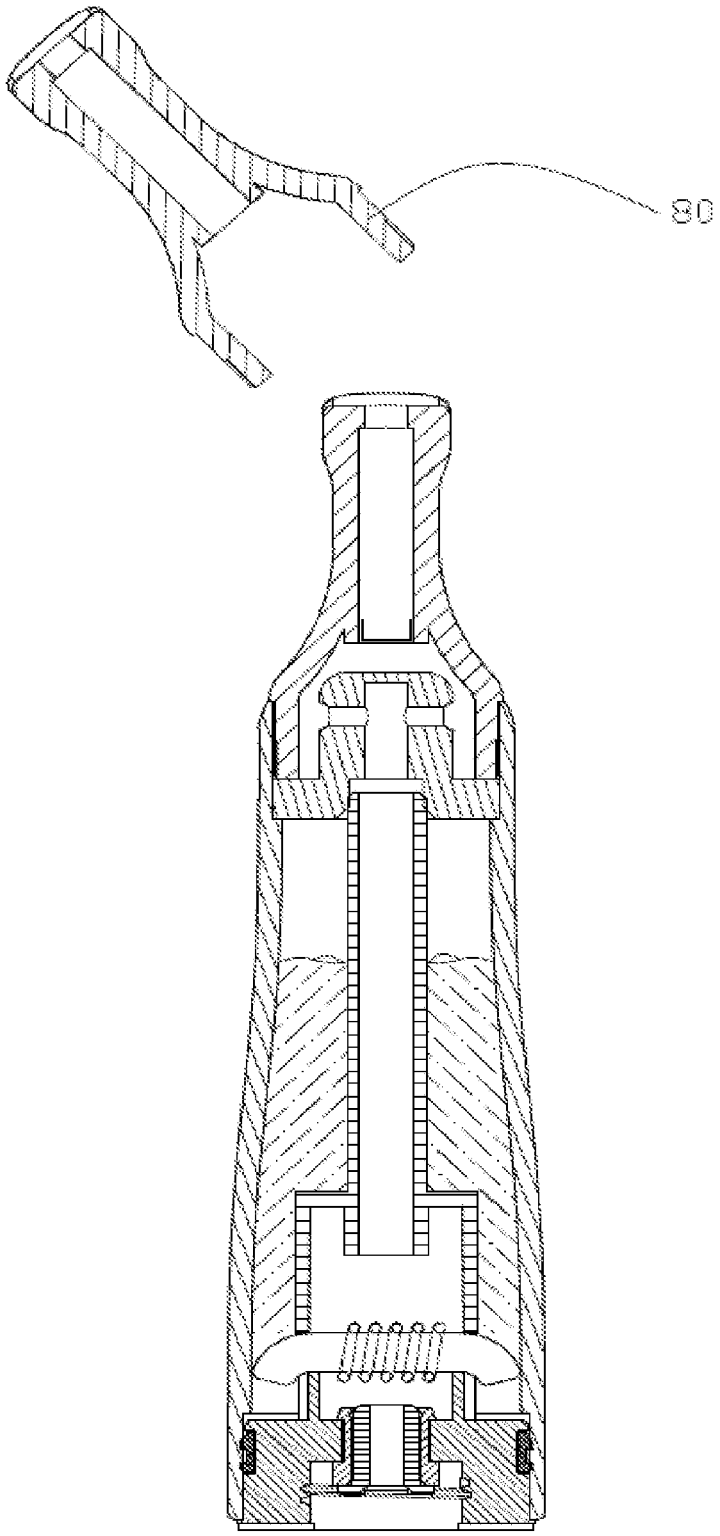
FIG. 7 illustrates one of steps of filling tobacco juice into the electronic cigarette according to the present invention.

Referring to FIGS. 1 to 3, an electronic cigarette 100 according to the present invention includes a cylindrical hollow atomizing stem 10, a first conductive ring 20 sleeved at the bottom of said atomizing stem 10 and airproof with the atomizing stem 10 by using a leakproof rubber ring 50, a second conductive ring 30 arranged in said first conductive ring 20 and insulated from the first conductive ring 20 by an insulation ring 60, a conduit 40 held in said atomizing stem 10, with base contacting said first conductive ring 20 tightly, a liquid blocker 70 arranged on the top of the atomizing stem 10, and a cigarette holder 80 arranged on the top of the atomizing stem 10 simultaneously and holding the liquid blocker 70 therein.

One feature of the electronic cigarette according to the present invention lies in that, the inner wall of said atomizing stem 10, the outer wall of said conduit 40, the top of said first conductive ring 20, and the bottom of said liquid blocker 70 together confine a liquid storage chamber 12 for storing tobacco juice therein. This liquid storage chamber 12, because of its good seal from other components of the electronic cigarette 100, can store tobacco juice without cigarette cotton, so the structure of the electronic cigarette 100 is greatly simplified as compared with a structure of the prior art.

Another feature of the electronic cigarette according to the present invention lies in that, the electronic cigarette 100 further includes a fiber rope 90, wherein two end portions of said fiber rope 90 are placed within the liquid storage chamber 12, and a middle portion thereof passes transversally through said conduit 40 and is held inside the conduit 40. In addition, a portion of said fiber rope 90 that is held within the conduit 40 (i.e., the middle portion) is wrapped with a heating wire 102, so that when tobacco juice is injected into said liquid storage chamber 12, the tobacco juice is automatically adsorbed into the fiber rope 90, and when the heating wire 102 is energized, the heating wire 102 atomizes the tobacco juice adsorbed in the fiber rope 90. This atomizing method has a high atomizing speed and generates more smoke as compared with the prior art.

Preferably, said first conductive ring 20 is provided at the bottom with a battery compartment 22, and at the top with a mounting hole 120 in communication with said battery compartment 22, wherein said second conductive ring 30 is mounted within the mounting hole, and said second conductive ring 30 is longitudinally provided with a flow-guiding hole 32 therein. Further, said insulation ring 60 is arranged between said first conductive ring 20 and said second conductive ring 30.

The two ends of said heating wire 102 are electrically connected to the first conductive ring 20 and the second conductive ring 30, respectively. When a battery is mounted in the battery compartment 22, positive and negative poles of the battery is respectively connected to said first and second conductive rings 20 and 30, so that the heating wire 102 is energized and thus provides heat, thereby quickly atomizing tobacco juice in the fiber rope 90.

Said liquid blocker 70 includes a body portion 72 and a flange 74 formed at the bottom of the body portion 72, wherein said flange 74 seals said liquid storage chamber 12, thereby preventing tobacco juice in the liquid storage chamber 12 from flowing backwards. The body portion 72 of said liquid blocker 70 is provided with a longitudinal hole 76 in communication with an interior of the conduit 40 and a transverse hole 78 in communication with the longitudinal hole 76. In addition, a gap 83 is formed between two side edges at the top of the body portion 72 and the inner wall of said cigarette holder 80.

An air flow hole 82 in communication with said transverse hole 78 is formed inside said cigarette holder 80.

A working procedure of the electronic cigarette 100 according to the present invention is described below. Referring to FIGS. 1 to 3, the heating wire 102 is heated up to produce a high temperature, thereby atomizing tobacco juice in the fiber rope 90. When a user sucks the electronic cigarette 100 from the cigarette holder 80, air outside the battery compartment 22 flows through the flow-guiding hole 32 into the conduit 40, and when flowing upwards, the external air carries smoke generated by atomizing the tobacco juice to flow. The mixed air flow goes through the conduit 40, and then flows into the air flow hole 82 inside the cigarette holder 80 through the longitudinal hole 76, the transverse hole 78, and the gap 83, and is finally inhaled by the user.

FIGS. 4 to 7 illustrate a procedure of filling tobacco juice into the liquid storage chamber 12. Firstly, the cigarette holder 80 is removed from the electronic cigarette 100. Then, the liquid blocker 70 is removed. The electronic cigarette is inclined at a certain angle, and then tobacco juice is poured from a bottle 200 into the liquid storage chamber 12. After that, the liquid blocker 70 and the cigarette holder 80 are mounted one by one, thereby completing the procedure of filling tobacco juice.

An integral design is realized for a heating unit and a tobacco juice storage unit of the electronic cigarette according to the present invention, the overall structure uses a vacuum-simulation design, no cigarette cotton is required for guiding a flow between the tobacco juice storage unit and the heating unit, and the atomizing effect is obviously improved, so that a generated air flow may better meet requirements of an electronic cigarette, the taste is more close to a true cigarette, and at the same time tobacco juice is sealed for storage, and a validity duration of the tobacco juice is greatly increased; in addition, the overall structure of the electronic cigarette is simplified, manufacturing cost is reduced, and production efficiency is improved.

The components of the electronic cigarette according to the present invention are not connected by welding, which effectively avoids pollution of soldering tin and soldering flux, thereby making it more environmental-friendly and hygienic.

The liquid blocker, the cigarette holder, and the body of the electronic cigarette according to the present invention are detachably connected, and after the tobacco juice is depleted, refilling can be performed, thereby prolonging the service life of the electronic cigarette.

The embodiment mentioned above is a preferable embodiment of the present invention, but is not intended to limit the present invention. Any other changes, modifications, replacements, combinations, and simplifications made without departing from the spiritual essence and principle of the present invention are within the scope of the present invention.

What is claimed is:

1. An electronic cigarette, comprising a hollow atomizing stem, a first conductive ring sleeved at the bottom of the atomizing stem and airproof with the atomizing stem, a second conductive ring arranged in the first conductive ring and insulated from the first conductive ring, a conduit held in the atomizing stem, with a base of the conduit directly contacting the first conductive ring tightly, a liquid blocker arranged on the top of the atomizing stem, a cigarette holder arranged on the top of the atomizing stem simultaneously and holding the liquid blocker therein, and tobacco juice;

wherein the inner wall of said atomizing stem, the outer wall of said conduit, the top of said first conductive ring, and the bottom of said liquid blocker together confine a liquid storage chamber that stores the tobacco juice.

2. The electronic cigarette according to claim 1, wherein said electronic cigarette further comprises a fiber rope, wherein two end portions of said fiber rope are placed within the liquid storage chamber, and a middle portion thereof passes transversally through said conduit and is held inside the conduit.

3. The electronic cigarette according to claim 2, wherein the middle portion of said fiber rope is wrapped with a heating wire.

4. The electronic cigarette according to claim 3, wherein a battery compartment is provided at the bottom of said first conductive ring, and a mounting hole in communication with the battery compartment is provided at the top of said first conductive ring; said second conductive ring is arranged inside said mounting hole; and an insulation ring is arranged between said first conductive ring and said second conductive ring.

5. The electronic cigarette according to claim 4, wherein two ends of said heating wire are electrically connected to said first conductive ring and said second conductive ring, respectively.

6. The electronic cigarette according to claim 1, wherein said liquid blocker comprises a body portion and a flange formed at the bottom of said body portion, wherein said flange seals said liquid storage chamber.

7. The electronic cigarette according to claim 6, wherein said body portion of said liquid blocker is provided with a longitudinal hole in communication with an interior of said conduit and a transverse hole in communication with said longitudinal hole.

8. The electronic cigarette according to claim 7, wherein a gap is formed between two side edges at the top of said body portion and the inner wall of said cigarette holder.

9. The electronic cigarette according to claim 8, wherein an air flow hole in communication with said transverse hole is formed within said cigarette holder.

10. The electronic cigarette according to claim 4, wherein a flow-guiding hole is provided longitudinally within said second conductive ring.

11. The electronic cigarette according to claim 1, wherein no cigarette cotton is provided within the liquid storage chamber.

12. The electronic cigarette according to claim 11, wherein the liquid storage chamber is a chamber filled only with tobacco juice.

13. The electronic cigarette according to claim 1, wherein the inner wall of said atomizing stem, the outer wall of said conduit, the top of said first conductive ring, and the bottom of said liquid blocker together form boundaries of the liquid storage chamber.

* * * * *